United States Patent [19]

Arai

[11] Patent Number: 4,537,849

[45] Date of Patent: Aug. 27, 1985

[54] PHOTOSENSITIVE ELEMENT HAVING ROUGHENED SELENIUM-ARSENIC ALLOY SURFACE

[75] Inventor: Akio Arai, Nagano, Japan

[73] Assignee: Fuji Electric Company, Ltd., Kanagawa, Japan

[21] Appl. No.: 571,860

[22] Filed: Jan. 18, 1984

[30] Foreign Application Priority Data

Jan. 25, 1983 [JP] Japan ..... 58-11132

[51] Int. Cl.[3] ..... G03G 5/08

[52] U.S. Cl. ..... 430/85; 430/133

[58] Field of Search ..... 430/56, 84, 85, 133, 430/127

[56] References Cited

U.S. PATENT DOCUMENTS

| | | | |
|---|---|---|---|
| 3,634,134 | 1/1972 | Trubisky et al. | 430/56 |
| 3,992,091 | 11/1976 | Fisher | 430/56 |
| 4,076,564 | 2/1978 | Fisher | 430/56 |
| 4,252,865 | 2/1981 | Gilbert et al. | 428/333 |

FOREIGN PATENT DOCUMENTS

| | | |
|---|---|---|
| 51-56635 | 5/1976 | Japan . |
| 53102646 | 9/1976 | Japan . |
| 53-92133 | 8/1978 | Japan . |
| 55-144251 | 11/1980 | Japan . |
| 58-93058 | 6/1983 | Japan . |

*Primary Examiner*—John L. Goodrow

*Attorney, Agent, or Firm*—Brumbaugh, Graves, Donohue & Raymond

[57] ABSTRACT

In the particular embodiment of the invention described in the specification, selected portions of the surface of a selenium-arsenic layer of a photosensitive element for use in electrophotography are provided with a superfinish having ridges and grooves in the range of 0.1 to 2.0 μm and a width of 3 μm or less by vibrating a grinding stones on the moving surface at a frequency of 1,000 to 1,500 cpm and an amplitude of 3 mm. The grindstone is held against the surface with a pressure of 0.3 to 0.4 kg/cm$^2$.

5 Claims, 2 Drawing Figures

PHOTOSENSITIVE ELEMENT HAVING ROUGHENED SELENIUM-ARSENIC ALLOY SURFACE

BACKGROUND OF THE INVENTION

The present invention relates to photosensitive elements for use in electrophotography and, more particularly, to a new and improved photosensitive element having a photoconductive layer providing good toner transferability, transfer paper separability, and toner cleanability.

Photosensitive elements for use in electrophotography are employed by charging and exposing the surface of a photoconductive layer to form a latent image, developing the latent image with toner, and transferring the developed image to another surface such as paper. The electrophotographic process also includes, subsequent to the above steps, a step of removing electric charges remaining on the photoconductive layer and a cleaning step of removing residual toner remaining on the surface of the photoconductive layer after transfer of the toner image. Since cleanability of the photoconductive layer governs the quality of a next image to be formed, a photoconductive layer of good cleanability is in demand.

Good image reproduction requires that conventional photosensitive elements for use in electrophotography have a very smooth photoconductive layer surface, and hence the photoconductive layer surface has been formed as a polished mirror surface. However, such a photoconductive layer has a high degree of adhesion to transfer paper or toner, resulting in impaired toner transferability, transfer paper separability, and toner cleanability. To avoid this problem, there have been used mechanical toner removal devices such as cleaning blades which impose strong scraping forces on the photoconductive layer surface for removing any residual toner. The mechanical toner removal devices, however, tend to damage the photoconductive layer surface or otherwise shorten the service life of the photosensitive element, with the result that images formed on the surface will have a reduced quality. It has recently been found that roughening the photoconductive layer surface to an appropriate extent is effective in eliminating the above drawback.

Various processes have been proposed to roughen the surface of the photoconductive layer. One method has been to form prescribed ridges and grooves in the surface of an electrically conductive substrate and form a photoconductive layer over the ridges and grooves. According to another process, foreign matter is embedded in the surface of a photoconductive layer. The former method is less feasible industrially since the entire substrate is required to have a uniform roughened surface with no localized blemishes or flaws in order to form images of good quality. The latter process is liable to reduce the service life of the photosensitive body because contact between the photoconductive layer and foreign matter promotes the generation of crystal nuclei of the photoconductive material at the points of contact. Therefore, the photoconductive layer should preferably be made only of a photoconductive material, and it would be most advantageous from the manufacturing standpoint if the surface of the photoconductive layer covering the electrically conductive substrate could be roughened after it has been formed. Prior photosensitive elements made of selenium, however, suffer from crystallization if they are roughened by such a process, e.g., if the surface of the photoconductive layer is roughened by grinding. Such crystallization impairs the electrostatic characteristics of the photoconductive layer.

It is an object of the present invention to provide a photosensitive element for use in electrophotography which has a surface which has been roughened after formation to provide an appropriate roughened finish.

SUMMARY OF THE INVENTION

The above object can be achieved by providing a photosensitive element for use in electrophotography which has a photoconductive layer made of a selenium-arsenic (Se-As) alloy at least at the outer surface thereof, and having an outer surface which is roughened by superfinishing.

The present invention is based on the discovery that a selenium-arsenic alloy is a photoconductive material which is highly resistant to crystallization resulting from grinding.

BRIEF DESCRIPTION OF THE DRAWINGS

An embodiment of the present invention will hereinafter be described with reference to the accompanying drawings, in which.

DETAILED DESCRIPTION OF PREFERRED EMBODIMENTS

Figure 1:
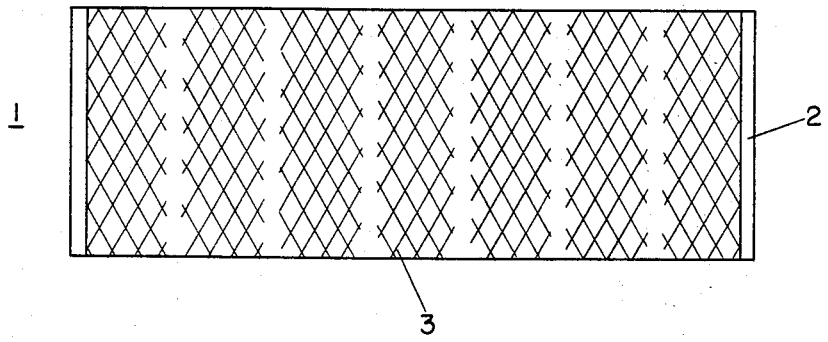
FIG. 1 is a plan view illustrating a representative photosensitive element prepared in accordance with the invention.
Figure 2:
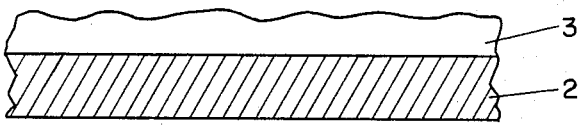
FIG. 2 is a fragmentary sectional view illustrating a portion of the photosensitive element of FIG. 1.

A typical photosensitive element 1 for use in electrophotography according to the invention, as shown in FIG. 1, is composed of a cylindrical electrically conductive substrate 2 of aluminum, for example, and a layer 3 of an Se-As alloy deposited by evaporation on the substrate 2. The surface of a photoconductive layer of the photosensitive element 1 is superfinished by subjecting it to a superfinishing process employing, for example, a #2000 grinding stone.

In one example, the superfinishing of the layer 3 was carried out by rotating the cylindrical photosensitive element at 50 rpm and vibrating a grinding stone in contact with the surface of the layer 3 at a frequency ranging from 1,000 to 1,500 cpm, at an amplitude of 3 mm. The grindstone was fed at a rate of 7/mm/rev., and was pressed against the surface of the layer 3 at a pressure ranging from 0.3 to 0.4 kg/cm$^2$.

As a result, the surface of the photoconductive layer was roughened with crossing strips in the range of 0.1 to 0.5 μm in the axial direction of the drum. The average width of ridges and grooves of the stripes was about 1.5 μm. Thus, the roughened surface produced was relatively uniform with only a small degree of roughening irregularity. When the photosensitive element thus manufactured was used in an ordinary copying machine, toner transferability, transfer paper separability, and cleanability were good, and image quality was good, and no imperfections that would appear as white stripes on an image were produced.

An ordinary surfacing finish process can be used for roughening the surface of the photoconductive layer to an appropriate extent. Dependent on the surface finishing pattern, however, flaws may be produced which will result in white stripes on images formed or image irregularities. As an example, grinding stripes in the circumferential direction of the drum tend to appear as white stripes on images. Therefore, it is preferable to superfinish the surface using a grinding stone to form interrupted roughened areas in the axial direction of the drum, with crossing roughened strips appearing in each roughened area. The produced surface roughness is relatively uniform and stable, and the superfinishing process can easily be controlled and automated. Therefore, the above process is highly advantageous in mass-producing photosensitive drums. The height of the ridges and grooves to be formed on the photoconductive layer are in the range of 0.1 to 2.0 μm, preferably in the range of 0.1 to 1 μm, and the width of the ridges and grooves should preferably be 3 μm or less, smaller than the diameter of toner particles used. If the ridges and grooves were larger, then spot-shaped charging irregularities would be formed and image defects would be generated. In addition, a cleaning blade would be damaged and have a reduced service life. If the ridges and grooves were too small, then the desired toner cleanability would not be achieved.

The photoconductive layer according to the present invention may have a lower layer composed of another Se-based material or another photoconductive material provided that the upper surface layer is composed of an Se-As alloy on a surface thereof which is roughened by superfinishing to provide good toner transferability, transfer paper separability, and toner cleanability. The photosensitive element has no foreign matter contained in the photoconductive layer and is effectively used as a highly reliable photosensitive element in a copying machine, a printer or the like.

I claim:

1. A photosensitive element for use in electrophotography comprising a photoconductive layer composed of a selenium-arsenic alloy at least at the exposed surface thereof, the exposed surface having a rough surface portion having ridges and grooves in the range from 0.1 to 2 microns in height and 3 microns or less in width created by superfinishing the exposed surface.

2. A photosensitive element according to claim 1 wherein the rough surface portion includes crossing stripes formed by a first set of parallel ridges and grooves oriented in a first direction crossing a second set of parallel ridges and grooves oriented in a second direction.

3. A photosensitive element according to claim 2 wherein the photosensitive element is cylindrical and the crossing stripes are formed by rotating the cylindrical photosensitive element about its axis while intentionally and rapidly vibrating a grinding stone in pressurized contact with the exposed surface of the element through a small amplitude in the millimeter range.

4. A photosensitive element according to claim 2 wherein the grinding stone is fed along the exposed surface at a feed rate of slightly more than twice the amplitude of vibration of the grinding stone per revolution of the cylindrical element.

5. A photosensitive element according to claim 2 wherein the frequency of the intentional vibration of the grinding stone in the range of 1,000 to 1,500 cpm and the amplitude of the vibration is about 3 mm.

* * * * *

UNITED STATES PATENT AND TRADEMARK OFFICE

CERTIFICATE OF CORRECTION

PATENT NO. : 4,537,849

DATED : August 27, 1985

INVENTOR(S) : Akio Arai

It is certified that error appears in the above-identified patent and that said Letters Patent is hereby corrected as shown below:

Column 2, line 54, "strips" should read --stripes--;
Column 3, line 7, "strips" should read --stripes--;
Column 4, line 24, "claim 2" should read --claim 3--;
Column 4, line 29, "claim 2" should read --claim 3--.

Signed and Sealed this

*Nineteenth* Day of *November 1985*

[SEAL]

*Attest:*

DONALD J. QUIGG

*Attesting Officer*

*Commissioner of Patents and Trademarks*